US007400850B2

(12) United States Patent
Romem

(10) Patent No.: US 7,400,850 B2
(45) Date of Patent: Jul. 15, 2008

(54) METHOD AND APPARATUS FOR IMPROVING IMAGE TRANSFER IN LIQUID ELECTROSTATIC PRINTING

(75) Inventor: Ilan Romem, Ramat Hasharon (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 163 days.

(21) Appl. No.: 11/187,071

(22) Filed: Jul. 22, 2005

(65) Prior Publication Data

US 2007/0019996 A1 Jan. 25, 2007

(51) Int. Cl.
*G03G 15/16* (2006.01)
*G03G 15/01* (2006.01)
*G03G 15/10* (2006.01)

(52) U.S. Cl. ..... 399/296; 399/302; 399/57

(58) Field of Classification Search ..... 399/57, 399/60, 237, 246, 249, 296
See application file for complete search history.

(56) References Cited

U.S. PATENT DOCUMENTS 6,684,048 B2 * 1/2004 Caruthers et al. ..... 399/296

* cited by examiner

*Primary Examiner*—Hoang Ngo

(57) ABSTRACT

A method for improving image transfer in liquid electrostatic printing includes applying at least one layer of toner to a surface, transferring the at least one layer of toner from the surface to an intermediate transfer member, and after transferring the at least one layer of toner to the intermediate transfer member and prior to transferring the at least one layer of toner from the intermediate transfer member to a final substrate, selectively applying a wetting substance to the surface and transferring the wetting substance from the surface to the at least one layer of toner transferred to the intermediate transfer member.

20 Claims, 2 Drawing Sheets

METHOD AND APPARATUS FOR IMPROVING IMAGE TRANSFER IN LIQUID ELECTROSTATIC PRINTING

FIELD OF THE INVENTION

The present invention relates generally to liquid electrostatic or Liquid Electro-photographic ("LEP") printing.

BACKGROUND OF THE INVENTION

The formation and development of latent images on the surface of photoconductive materials using liquid toner, the LEP process, is well known. The basic process involves placing a uniform electrostatic charge on a photo imaging plate ("PIP") and exposing the PIP to a light and shadow image or to a scanning laser to dissipate the charge on the areas of the PIP exposed to the light and developing to form a latent electrostatic image. The resultant latent image is developed by subjecting the latent image to a liquid toner comprising a carrier liquid and colored toner particles. These toner particles are generally comprised of a pigmented polymer. Generally, the development is carried out, at least partially, in the presence of an electric field, such that the toner particles are attracted either to the charged or discharged areas, depending on the charge of the particles and the direction and magnitude of the field.

This image may then be transferred to a substrate such as paper or plastic film, often via an intermediate transfer member ("ITM") which is typically covered with a replaceable blanket. The transferred image may then be permanently affixed to the substrate by the application of pressure, heat, solvent, overcoating treatment or other affixing processes. In general, in the commercial process used by HP-Indigo, the ITM is heated to a temperature that causes the toner particles and residual carrier liquid to form a film in the printed areas which is transferred to the final substrate by heat and pressure. Fixing to the final substrate takes as part of the transfer process.

There are two basic methods for printing in color using an LEP process. The first method is a 4-shot process. In the 4-shot process, each printed color separation is transferred separately from the ITM to the substrate, until the full color image is achieved. Once the full color image has been deposited onto the substrate, the substrate is passed out of the printer. The second method is called a 1-shot process. In the 1-shot process, the printed colors are transferred one at a time to the ITM. When all the colors have been transferred to the ITM they are transferred together from the ITM to the substrate at the same time, instead of one at a time, like in the 4-shot process. In some applications more than 4 colors are used to form the final image. Color toners that are widely used in the industry include the HP ElectroInk® products which contain colored polymer toner particles and a carrier liquid including a volatile portion, such as Isopar®L. In principle, there is no limit to the number of colors that can be used in either process.

Conventionally, electrophoresis is used to develop an image on a PIP. In a typical electrophoretic printer or copier, a PIP charged to a high voltage is exposed to light in certain regions, producing a latent image in which the voltage is reduced to a lower voltage depending on the exposure at each position. A toner, such as a liquid toner, with toner particles dispersed in a carrier liquid, is placed between the surface of the PIP and a development electrode, electrified to a voltage that is intermediate between the maximum and minimum voltage on the selectively exposed photosensitive layer. The development electrode thus produces an electric field normal to the surface of the PIP which is directed toward the PIP or away from it, depending on the potential at each position which in turn depends on how much light each position was exposed to.

Toner particles in the liquid toner migrate toward or away from the PIP, depending on the direction of the electric field at each position, and as a result, toner particles are selectively deposited on the surface of the PIP, converting the latent image into a developed toner image. For positions that were exposed to an intermediate amount of light, the density of toner particles may depend on the exposure at that position.

Japanese patent publication 50-152741, the disclosure of which is incorporated herein by reference, describes an electrophoretic printer in which liquid toner emerges from an opening in the middle of an electrode, and flows in along a gap between the electrode and a rotating PIP. The toner flows in both direction from the opening, i.e., in the same direction as the rotating cylinder, and in the opposite direction.

Alternatively to the electrophoresis method, a binary image developing technique is used. U.S. Pat. No. 5,596,396 to Landa et al, U.S. Pat. No. 5,610,694, to Lior et al, and PCT application PCT/IL2005/000217 to Kella, the disclosures of which are incorporated herein by reference, describe a development method called binary image development. In binary image development, instead of introducing a freely flowing liquid toner with charged particles against the surface of the PIP, a viscous concentrated layer of charged liquid toner particles coating a developer cylinder of a binary image developer ("BID") is placed against the surface of the PIP. The developer cylinder is at a voltage intermediate between the maximum and minimum voltage of the PIP. The two cylinders rotate, and different portions of the toner layer progressively come into contact with the PIP at a nip between the two cylinders. Depending on the direction of the electric field between the developer cylinder and the PIP at each point as it passes the nip, portions of the toner layer either are transferred from the developer cylinder to the PIP, or remain on the developer cylinder. This produces a developed toner image on the surface of the PIP, an image that, at each point, is either toned by the toner or left untoned.

Alternatively, as described in U.S. Pat. No. 5,610,694, less than the full thickness of the toner layer is transferred from the developer cylinder to the PIP, at those points where toner is transferred at all. This method may make the resulting developed image on the PIP less sensitive to possible non-uniformity of the toner layer on the developer cylinder.

To produce the layer of concentrated toner on the developer cylinder in the first place, liquid toner is run in a narrow gap between the rotating developer cylinder and an electrode, which produces an electric field which causes toner particles to adhere to the developer cylinder. As each portion of the surface of the development cylinder rotates beyond the end of the electrode, a squeegee removes excess liquid from that portion of the surface, leaving a uniform layer of concentrated toner coating the development cylinder. After each portion of the surface of the developer cylinder passes the nip and transfers part of the layer to the photosensitive member, a cleaning roller or scraper removes the remaining parts of the toner layer from that portion of the surface of the developer cylinder, providing a clean surface so that a uniform layer of toner can be coated on the developer cylinder for the next image as each portion of its surface passes the electrode again.

Japanese patent application number 09086192 (publication number 10282795), the disclosure of which is incorporated herein by reference, describes such an image development system in which a liquid toner flows into the gap between the electrode and the developer cylinder through an opening in the middle of the electrode. The electrode is adjacent to one side of the developer cylinder, whose surface is moving upward on that side. Some of the liquid toner is carried upward with the surface of the developer cylinder, while some of the liquid toner flows downward along the surface of the developer cylinder, moving in a direction opposite to the direction of motion of the surface. In both the upward and downward moving liquid toner, some toner particles migrate to the surface of the developer cylinder under the influence of the electric field produced by the electrode, and adhere to the developer cylinder.

A similar image development system is described as prior art in PCT publication WO 01/92962, the disclosure of which is incorporated herein by reference, but with the electrode below the developer cylinder instead of to its side. Most of the liquid toner coming out of the opening in the middle of the electrode flows along the gap in the direction of motion of the developer cylinder, but some of it flows along the gap in the opposite direction.

SUMMARY OF THE INVENTION

An aspect of some embodiments of the invention relates to improving image transfer by providing wetting to the image prior to final transfer to a substrate. In some exemplary embodiments, wetting is provided to a PIP, which in turn wets color image separations that have already been transferred to the ITM. In some exemplary embodiments of the invention, a BID is used to wet the PIP. Optionally, wetting occurs during null cycles. Optionally, wetting occurs between toner layer deposits on the ITM. Optionally, BID wetting of the PIP is used in a 1-shot printing apparatus. In some exemplary embodiments of the invention, the liquid used for wetting is the carrier liquid.

One disadvantage of the color LEP process involves the over drying of color layers deposited on the ITM, especially in the 1-shot process. This over drying is a consequence of the earlier deposited color layers remaining on the blanket while awaiting the deposit of further color layers. It has been found that over drying of color layers results in poor image transfer to the substrate and sometimes, reduction in ITM printing blanket life, back transfer of a portion of the image from the blanket to the PIP, which causes image degradation in future printings.

There is thus provided in accordance with an exemplary embodiment of the invention a method for improving image transfer in one-shot liquid electrostatic printing, comprising providing at least one layer of toner to an intermediate transfer member; and, applying selectively a wetting substance to the at least one toner layer, prior to transfer of the image to a final substrate. Optionally, the applying is performed by a binary image developer. Optionally, the toner layer comprises colored toner particles and a carrier liquid and wherein the wetting substance is the carrier liquid or a volatile component thereof. Optionally, the applying occurs during a null cycle. Optionally, a plurality of layers of toner is provided to an intermediate transfer member. Optionally, applying selectively occurs between providing the plurality of layers of toner.

There is thus provided in accordance with an exemplary embodiment of the invention an apparatus for improving image transfer in liquid electrostatic printing, comprising at least one toner binary image developer for providing at least one layer of toner to an intermediate transfer member; and, at least one wetting binary image developer for selectively applying a wetting substance to the at least one toner layer, prior to transfer of the image to a final substrate. Optionally, the toner layer comprises colored toner particles and a carrier liquid and wherein the wetting substance is the carrier liquid or a volatile component thereof. Optionally, the wetting binary image developer applies the wetting substance during a null cycle. Optionally, the apparatus is a one-shot printing apparatus. Optionally, the apparatus is a multi-engine printing apparatus. Optionally, the at least one toner binary image developer provides a plurality of layers of toner to the intermediate transfer member. Optionally, the at least one wetting binary image developer selectively applies a wetting substance between the plurality of layers.

BRIEF DESCRIPTION OF THE DRAWINGS

Exemplary non-limiting embodiments of the invention are described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. Referring to the attached figures.

DETAILED DESCRIPTION OF EXEMPLARY EMBODIMENTS

Figure 1:
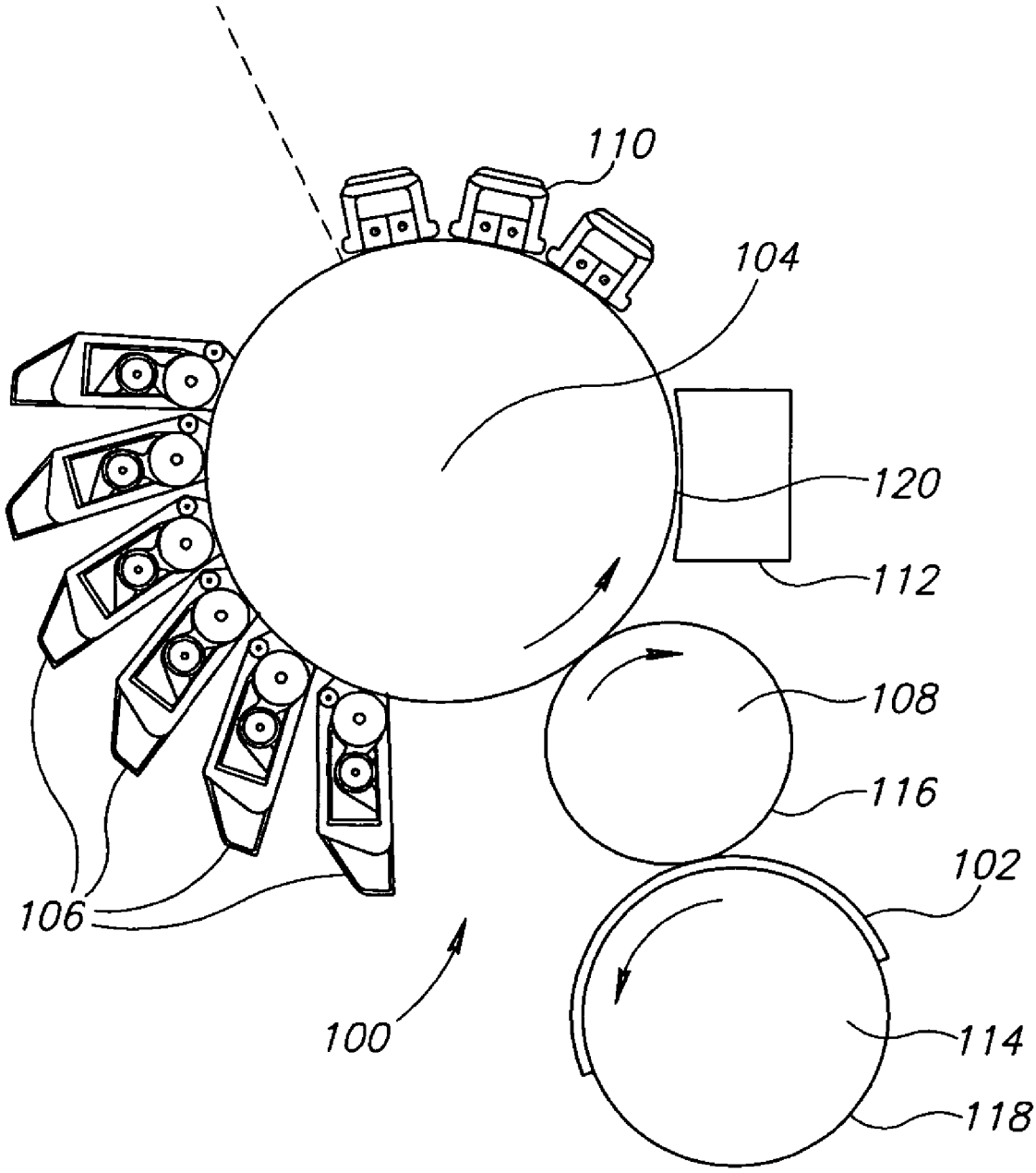
FIG. 1 is a simplified schematic view of a photo imaging plate and surrounding components, in accordance with an exemplary embodiment of the invention; and, FIG. 2 is a flow chart depicting a method for improving the operation of an LEP printer, in accordance with an exemplary embodiment of the invention.

Referring to FIG. 1, a printing engine 100 is shown in an exemplary embodiment of the invention. In an exemplary embodiment of the invention, printing engine 100 is optionally used in conjunction with any one of the following HP Indigo® Presses W-3200, WS-4000 and WS-4050. In a conventional LEP process, a latent image is made available for printing onto substrate 102 as described above in the Background section. A PIP 104 is given a charge by at least one charge unit 110. The charging on the PIP forms a latent image which corresponds to an image which is to be printed by LEP printing engine 100. Liquid toner is discharged from at least one BID 106 which adheres to the appropriately charged areas of PIP 104, thereby developing the latent image. The developed image is transferred to an ITM 108 and heated on the ITM. The developed image is transferred to a final substrate 102 as described below.

PIP 104 is optionally discharged and cleaned by a cleaning/discharging unit 112 prior to recharging of PIP 104 in order to start another printing cycle. As substrate 102 passes by ITM 108, the image located on ITM 108 is then transferred to substrate 102. Affixation of the image to substrate 102 is facilitated by locating substrate 102 on the surface 118 of impression roller 114, which applies pressure to substrate 102 by compressing it between impression roller 114 and ITM 108 as the image is being transferred to substrate 102. Eventually, substrate 102 bearing the image exits the printer. In some exemplary embodiments of the invention, the printer is a sheet-fed printer. Optionally, the printer is a web-fed printer.

FIG. 1 shows a plurality of BID units 106 located in image development area 100. In some exemplary embodiments of the invention, each BID contains a different color toner, for use in producing multi-color images. In an embodiment of the invention, at least one BID contains only a wetting substance, such as the carrier liquid used in the toner, for example, or a volatile component thereof such as Isopar® L. Generally, a color is located in each of the other BID units. As described above, a 1-shot process printer transfers a complete multi-color image to substrate 102 at one time. For example, if an image is comprised of four color separations, black, cyan magenta and yellow, an exemplary mode of operation would involve charging PIP 104 with the appropriate pattern for the black toner. As PIP 104 rotates, the BID that contains black toner applies the toner onto the PIP surface 120, developing the latent image. The yellow toner image is then transferred to the ITM surface 116 where it remains, awaiting the deposit of the remaining color layers, cyan, magenta and black. While waiting, the image is heated to a temperature in which the carrier liquid is solvated by the toner particles. This cycle repeats for each of the remaining colors until a complete multi-colored image is located on ITM 108. Once the complete image is assembled, it is deposited all at once onto substrate 102.

In the conventional LEP process, problems may arise when multi-layered images are printed using the 1-shot technique, especially when more than four layers (separations) are printed. As described above, the initial toner layers deposited onto ITM 108 must wait for the rest of the toner layers before being deposited on substrate 102. This delay often causes the initial layers to become dry, as the carrier liquid in the toner particles partially evaporates during the time of each rotation of the heated ITM 108. This drying-out results in reduced transfer of the image to substrate 102, and in some cases causes the dried-out toner to transfer back to PIP 104 from ITM 108, while a subsequent separation is being transferred.

Liquid toner becoming overly dry may also occur when null cycles are used in a printing process. Briefly, a null cycle is operation of a printing apparatus as if normal printing is being performed; however, there is no transfer or development of any image. Null cycles are most often used in multi-engine printing apparatuses when the number of color separations in a print job are not identical over multiple print engines. During a null cycle, toner located on an ITM begins to dry out, similar to toner that waits on an ITM during the 1-shot process. Sometimes, null cycles are used in white toner printing processes, due to the excess wetness of white toner. In this case, the null cycle is used for drying the white toner prior to application onto a substrate.

Figure 2:
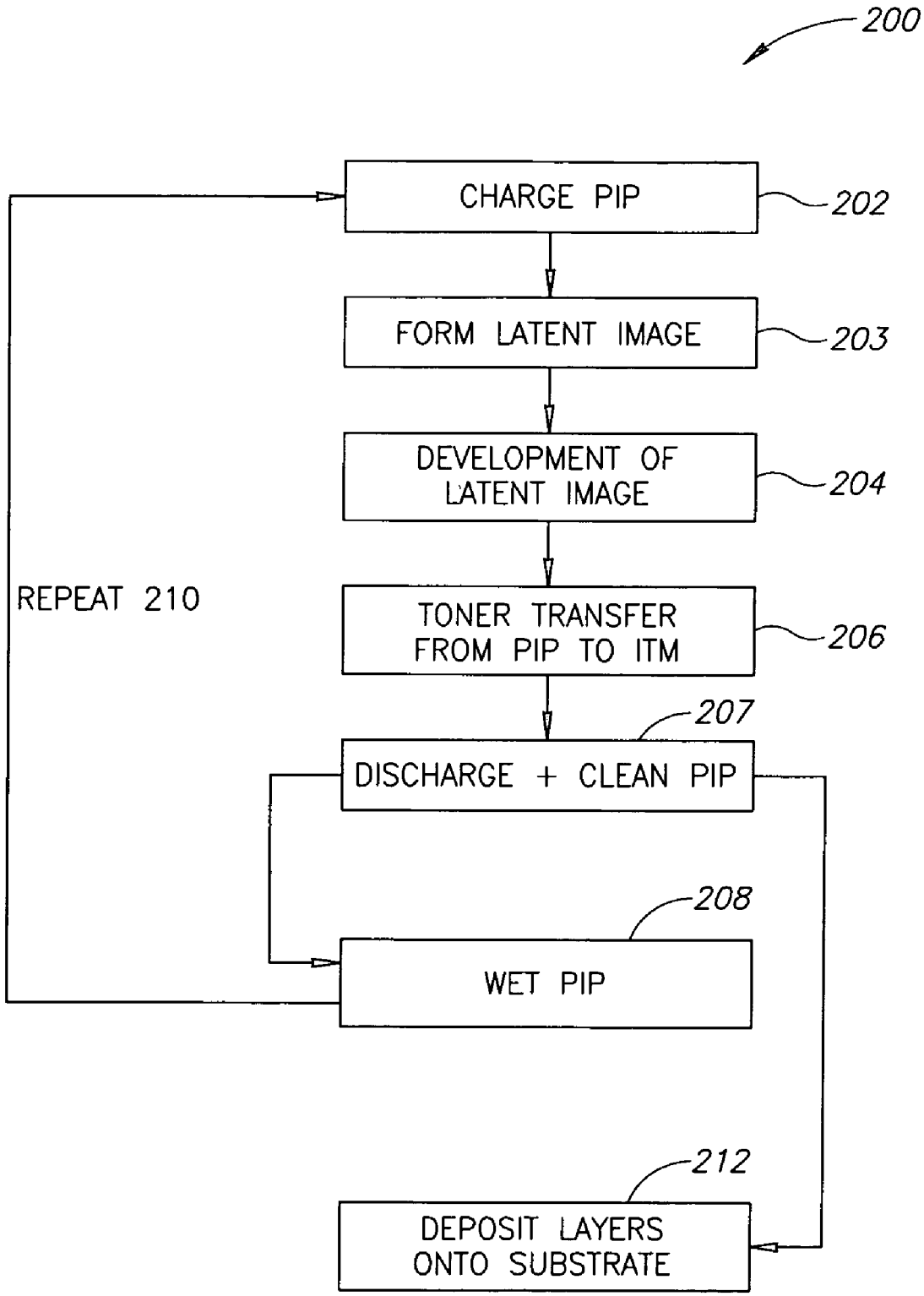

Referring to FIG. 2, a flowchart is shown which sets forth a method 200, in an exemplary embodiment of the invention, for improving image transfer in the LEP process by preventing the over-drying of toner on ITM 108. An LEP process commences by charging (202) PIP 104 and forming (203) the appropriate latent image for a first toner layer. As PIP 104 rotates past a BID, which contains toner for forming the first toner separation, the BID develops (204) the latent image on PIP 104. The toner particles adhere to the appropriately charged portions of PIP surface 120 until they interface with ITM 108 at which time the toner particles transfer (206) to the ITM surface 116. In some exemplary embodiments of the invention, PIP 104 is discharged and cleaned (207) prior to either wetting (208) PIP 104 or depositing (212) the image onto substrate 102.

A null cycle is optionally inserted between the transfer (206) of toner to ITM 108 and the charging (202) of PIP 104 for the next toner layer. In an exemplary embodiment of the invention, the null cycle is used to deposit (208) a wetting substance on PIP 104 for eventual transfer to ITM 108. The wetting substance, upon deposit onto ITM 108, then wets the toner image thereon, preventing over drying of the image and the resultant poor image transfer and/or back transfer. Optionally, the wetting substance is a carrier liquid. In an exemplary embodiment of the invention, the wetting substance is Isopar® L.

In an exemplary embodiment of the invention, a BID is used to deposit the wetting substance on PIP surface 120. In some exemplary embodiments of the invention, a thin layer of carrier liquid or a component thereof is deposited on PIP 104, which is then transferred to ITM surface 116. After the creation of a carrier liquid layer on ITM surface 116, the cycle is repeated (210) for the next toner layer until all the layers of the image have been laid down onto ITM surface 116. The multi-layered image is then deposited (212) onto a final substrate which eventually exits printing engine 100. Optionally, some or all of the layers utilize a different color of toner. Optionally, wetting (208) occurs between discharge and cleaning (207) and deposit (212) without repeating (210) a cycle.

In some exemplary embodiments of the invention, wetting does not occur between every layer of toner. That is, wetting is selectively applied depending on the toners being used and the situation. For example, if white ink is used to form an image, it may be undesirable to wet the white ink layer. Optionally, wetting is performed more than once between toner layers, for example, if there will be a long time delay before the transmission of another toner layer and/or if the particular toner has been determined to be at high risk of over-drying.

In some exemplary embodiments of the invention, wetting is applied to early layers of toner but not to layers of toner which come later. This might be desirable because the early layers of toner remain on ITM 108 for a longer period of time than the later layers and are therefore more prone to over-drying. It should also be noted that the method 200, and variations thereof, is optionally used with any number of toner layers. Optionally, wetting is not performed on the last toner layer, for example because the image is going to be transferred to the final substrate before over-drying becomes a problem for the last toner layer.

As the alternating layers of toner and carrier liquid are laid onto ITM 108 to create an image, at least a portion of the carrier liquid in the wetting layer is absorbed into the underlying toner layers, creating the wetting effect desired. Although the heated ITM 108 causes carrier liquid to evaporate, which causes the over-drying in the first place, the heat also facilitates the absorption by the toner layers of the carrier liquid.

The method of improving image transfer by inserting a null cycle for wetting the image formed on ITM 108 is optionally applied to any printing process where a null cycle is utilized and where image drying before deposit on a final substrate is of concern. For example, in the first null cycle example described above, multi-engine printing apparatuses can optionally improve image transfer by wetting toner images during those null cycles which are conventionally used when the number of color separations in a print job are not identical over the multiple print engines. This technique is suited for use with a multi-engine LEP printer such as the HP Indigo® Press W-3200.

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art. Examples of variations that are possible include wetting of the images directly on the ITM and wetting where there other development methods are used, for example where development takes place by electrophoresis rather than BID. Also other liquid toners as known in the art could be used. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the invention and which are described as examples. Structure and acts described herein are replaceable by equivalents, which perform the same function, even if the structure or acts are different, as known in the art. Therefore, the scope of the invention is limited only by the elements and limitations as used in the claims.

The invention claimed is:

1. A method for improving image transfer in liquid electrostatic printing, comprising:

applying at least one layer of toner to a surface;

transferring the at least one layer of toner from the surface to an intermediate transfer member; and after transferring the at least one layer of toner to the intermediate transfer member and prior to transferring the at least one layer of toner from the intermediate transfer member to a final substrate, selectively applying a wetting substance to the surface and transferring the wetting substance from the surface to the at least one layer of toner transferred to the intermediate transfer member.

2. A method according to claim 1, wherein said applying a wetting substance is performed by a binary image developer.

3. A method according to claim 1, wherein said at least one layer of toner comprises colored toner particles and a carrier liquid, and wherein said wetting substance is said carrier liquid or a volatile component thereof.

4. A method according to claim 1, wherein said applying a wetting substance occurs during a null cycle.

5. A method according to claim 1, wherein a plurality of layers of toner are applied to the surface and transferred from the surface to the intermediate transfer member.

6. A method according to claim 5, wherein said applying a wetting substance selectively occurs between transferring said plurality of layers of toner to the intermediate transfer member.

7. An apparatus for improving image transfer in liquid electrostatic printing, comprising:

at least one toner binary image developer configured to apply at least one layer of toner to a surface;

an intermediate transfer member configured to receive transfer of the at least one layer of toner from the surface; and at least one wetting binary image developer configured to selectively apply a wetting substance to the surface, wherein, after transfer of the at least one layer of toner to the intermediate transfer member and prior to transfer of the at least one layer of toner from the intermediate transfer member to a final substrate, the surface is configured to transfer the wetting substance to the at least one layer of toner transferred to the intermediate transfer member.

8. An apparatus according to claim 7, wherein said at least one layer of toner comprises colored toner particles and a carrier liquid, and wherein said wetting substance is said carrier liquid or a volatile component thereof.

9. An apparatus according to claim 7, wherein said at least one wetting binary image developer is configured to apply said wetting substance during a null cycle.

10. An apparatus according to claim 7, wherein said apparatus is a one-shot liquid electrostatic printing apparatus.

11. An apparatus according to claim 7, wherein said apparatus is a multi-engine liquid electrostatic printing apparatus.

12. An apparatus according to claim 7, wherein said at least one toner binary image developer is configured to apply a plurality of layers of toner to said surface, and said intermediate transfer member is configured to receive transfer of said plurality of layers of toner from said surface.

13. An apparatus according to claim 12, wherein said at least one wetting binary image developer selectively applies said wetting substance between said plurality of layers of toner.

14. A method according to claim 1, wherein said applying at least one layer of toner further includes developing a latent image on the surface, wherein said transferring the at least one layer of toner from the surface includes transferring the latent image from the surface to the intermediate transfer member, and wherein said transferring the at least one layer of toner from the intermediate transfer member includes transferring the latent image from the intermediate transfer member to the final substrate.

15. A method according to claim 1, further comprising positioning said intermediate transfer member between and in contact with said surface and said final substrate.

16. A method according to claim 1, wherein said surface comprises a surface of a photo imaging plate.

17. A method according to claim 1, wherein said method is applied in one-shot liquid electrostatic printing.

18. An apparatus according to claim 7, wherein said at least one layer of toner develops a latent image on the surface, and wherein said intermediate transfer member is configured to receive the latent image from the surface and transfer the latent image to the final substrate.

19. An apparatus according to claim 7, wherein said intermediate transfer member is positioned between and in contact with said surface and said final substrate.

20. An apparatus according to claim 7, wherein said surface comprises a surface of a photo imaging plate.

* * * * *